US011185178B1

(12) United States Patent
Nobari

(10) Patent No.: US 11,185,178 B1
(45) Date of Patent: Nov. 30, 2021

(54) ICE RESTRAINING DRINKING RECEPTACLE

(71) Applicant: Fariborz Sahebdel Nobari, Annandale (AU)

(72) Inventor: Fariborz Sahebdel Nobari, Annandale (AU)

( * ) Notice: Subject to any disclaimer, the term of this patent is extended or adjusted under 35 U.S.C. 154(b) by 110 days.

(21) Appl. No.: 16/594,060

(22) Filed: Oct. 6, 2019

Related U.S. Application Data

(60) Provisional application No. 62/741,763, filed on Oct. 5, 2018.

(51) Int. Cl.
*A47G 19/22* (2006.01)

(52) U.S. Cl.
CPC ..... *A47G 19/2211* (2013.01)

(58) Field of Classification Search
CPC ..... A47G 19/2211; A47G 19/2205; A47G 19/2272; F17C 1/243; A61M 5/3205
USPC ..... 220/719; 206/366
See application file for complete search history.

(56) References Cited

U.S. PATENT DOCUMENTS

| | | | | | |
|---|---|---|---|---|---|
| 2,753,049 | A * | 7/1956 | Gaines | A47G 19/2211 | 210/469 |
| 3,313,447 | A * | 4/1967 | Dean | A47G 19/2211 | 220/719 |
| 3,549,044 | A * | 12/1970 | Lerner | A47G 19/2211 | 220/719 |
| 2011/0309092 | A1* | 12/2011 | Gatta | A47G 19/2205 | 220/703 |
| 2012/0024873 | A1* | 2/2012 | Roseblade | A47G 19/2211 | 220/731 |

* cited by examiner

*Primary Examiner* — King M Chu
(74) *Attorney, Agent, or Firm* — Michael D. Eisenberg

(57) ABSTRACT

An ice restraining drinking receptacle provides a housing that retains a fluid and ice. An ice trap in the housing restrains the ice from moving near the drinking rim of the upturned receptacle while drinking therefrom. The receptacle comprises a housing defined by an upper region having a rim, and a lower region. The housing further includes a sidewall, a base end disposed within the lower region, and a rim end disposed within the upper region. An ice trap restrains movement of ice past the upper region rim. In an embodiment, the ice trap includes a plurality of protrusions disposed in a spaced-apart relationship that allows fluid to flow between protrusions to the rim for drinking. Further, the protrusions are disposed in a circumferential relationship across the upper region and inner surface of the housing. The pointy apex of the protrusions helps restrict passage of ice to the rim.

20 Claims, 6 Drawing Sheets

ICE RESTRAINING DRINKING RECEPTACLE

RELATED APPLICATIONS

This application claims priority from provisional application No. 62/741,763, which was filed on Oct. 5, 2018, and is hereby incorporated by reference in its entirety.

TECHNICAL FIELD

The present invention relates generally to a drinking receptacle that contains a fluid and ice, and utilizes a unique mechanical barrier to restrain the ice from near the drinking rim of the upturned receptacle while drinking therefrom; whereby the barrier includes multiple protrusions extending from the inner surface of the drinking receptacle, such that the ice does not move beyond a desired elevation of the receptacle, so as not to engage the teeth or lips of the drinker.

BACKGROUND ART

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Drinking receptacles or vessels, such as mugs and cups, are used for retaining drinking fluids. Often, a cold beverage is desired. Creating a cold beverage may necessitate adding ice into the drinking receptacle. It is often desirable to consume a cold drink in various time of a day. Some want an icy cold beer after a hard day of work, others may simply prefer to drink something cold. One way to keep the drink cold is adding ice to the cup to lower the temperature of the drink. However, issues arise when the user is drinking from the cup with ice. As the user raises the cup to the mouth, ice tends to congregate to the user's mouth as the user drinks.

Moreover, ice always float on top of the most liquid, because ice has less density than water. However, when the user is drinking, the floating ice will create a constant contact to user's lips or face. While most users enjoy pouring a cold drink down his or her throats, having a plurality of ice touching the user's lips or face is not as enjoyable as drinking the drink. While using a straw can prevent the ice from contacting the user's lips or face, some drinks are simply more enjoyable without using a straw. Moreover, sticking a straw in a cup of drink with ice cube may create another issue. The ice cubes may form a blockade to the straw, so the user may have a hard time finish drinking, because there is more ice than the liquid, and eventually the user may still need to tip the cup to the mouth to finish the last bit of liquid in the cup.

The present invention provides a solution to all the abovementioned issues by providing a drinking device with an ice trap. The ice trap is positioned on the inner surface of the present invention. The ice trap includes multiple protrusions configured to form a blockade to prevent the ice from contacting the user's lips or face while leaving some space for the liquid to flow past the ice trap. With the present invention, the user can pour the drink, adds some ice, and drink all the liquid in the cup without having the ice contacting the user's lips or face.

Different types of mugs are disclosed in U.S. Pat. Nos. 2,753,050A; 5,971,202; 5,727,712; and 20050135186.

BRIEF SUMMARY OF THE INVENTION

Illustrative embodiments of the disclosure are generally directed to an ice restraining drinking receptacle provides a housing that retains a fluid and ice. An ice trap in the housing restrains the ice from moving near the drinking rim of the upturned receptacle while drinking therefrom. The receptacle comprises a housing defined by an upper region having a rim, and a lower region. The housing further includes a sidewall, a base end disposed within the lower region, and a rim end disposed within the upper region.

An ice trap restrains movement of ice past the upper region rim. The ice trap includes a plurality of protrusions disposed in a spaced-apart relationship that allows fluid to flow between protrusions to the rim for drinking. Further, the protrusions are disposed in a circumferential relationship across the upper region and inner surface of the housing. The configuration and apex of the protrusions helps restrict passage of ice to the rim. The protrusions positioned on the inner surface of a cup to form a blockade that is large enough to prevent the ice from contacting the user's lips or face, while still leaving enough space between each protrusion to allow the liquid to flow from the cup to the user's mouth.

In some embodiments, the ice restraining drinking receptacle comprises a housing defined by an upper region and a lower region, the housing further being defined by a sidewall, a base end disposed within the lower region, and a rim end disposed within the upper region and having a rim, the rim end forming an opening.

In other embodiments, the ice restraining drinking receptacle may also include an ice trap having a plurality of protrusions disposed in a spaced-apart relationship, the protrusions further being disposed in a circumferential relationship on the inner surface and the upper region of the housing.

In another aspect, the housing comprises a mug.

In another aspect, the housing has a cylindrical shape.

In another aspect, the protrusions are defined by a mount end and an apex end.

In another aspect, the protrusions form all the way from the mount end to the apex end.

In another aspect, the apex end is pointed.

In another aspect, the protrusions are connected in an annular arrangement to the inner surface of the housing.

In another aspect, the protrusions are individually joined in an annular arrangement to the inner surface of the housing.

In another aspect, the protrusions include at least one of the following shapes: a triangular shape, an oval shape, a semi-circular shape, a hammer shape, and a rectangular shape.

In yet a further aspect, an ice restraining drinking receptacle comprises a vessel defined by an upper region and a lower region. The vessel is defined by a sidewall, a base end disposed within the lower region, and a rim end disposed within the upper region and having a rim. The rim end forms an opening. An ice trap is formed by a ring having an outside circumference and an inside circumference. The ring is hollow inside the inside circumference and the outside diameter is less than an inside diameter of the sidewall of the vessel. A plurality of protrusions are disposed in a spaced-apart relationship. The protrusions are disposed in a circumferential relationship on the inner surface and the upper region of the vessel. The protrusions are attached to the outer circumference of the ring and the sidewall of the vessel.

In still another aspect of the ice restraining drinking receptacle, the protrusions have surfaces that are level and continuous with a surface of the ring.

One objective of the present invention is to help prevent ice from contacting the user when the user put a mug near the mouth to drink.

Another objective is to allow the fluid inside the housing to flow through the spaces between the protrusions.

Yet another objective is to maintain the fluid inside the housing at a cool temperature controlled by the number and size of ice therein.

An exemplary objective is to provide an inexpensive to manufacture drinking receptacle.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

DESCRIPTION OF THE PREFERRED EMBODIMENTS

Figure 1:
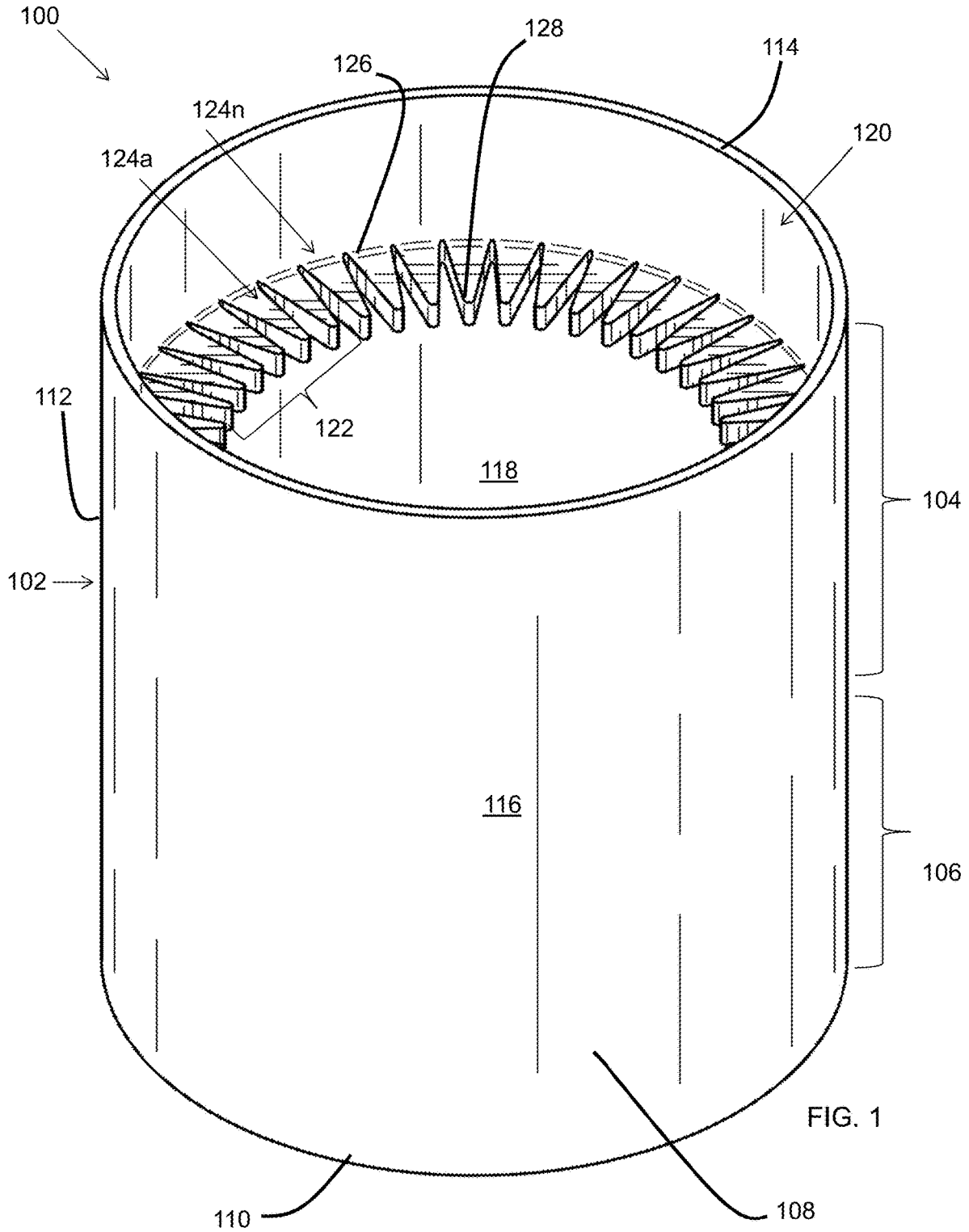
FIG. 1 is a perspective view of an exemplary ice restraining drinking receptacle, according to one embodiment.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read together with the specification, and are to be considered a portion of the entire written description of this invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Referring now to the drawings, FIG. 1 illustrates an ice restraining drinking receptacle 100, hereafter "receptacle 100". The receptacle 100 comprises a housing 102 that is sized and dimensioned to contain a fluid 200 and ice 202. The fluid may include, without limitation, a water, soda, juice, and an alcoholic beverage. The ice may be an ice cube, ice shards, a frozen polymer, or any frozen member configured to cool the fluid. The housing 102 is configured to enable drinking therefrom by tipping a rim 114 over at an angle to allow the fluid 200 to pour out into the mouth of the user. In some embodiments, the receptacle 100 may include, without limitation, a mug, a cup, a jug, a thermos, a glass, and a bowl.

As shown in FIG. 1, the housing 102 is defined by an upper region 104 disposed proximal to the user's mouth when drinking; and a lower region 106 disposed distally from the mouth, and upon which the housing rests. In one non-limiting embodiment, the upper and lower regions 104, 106 are equidistant from their respective ends. The housing 102 is further defined by a sidewall 108 that may be cylindrically shaped. However, the sidewall 108 may also take different shapes, such as a cube shape or a rectangular shape, depending on the configuration of the housing 102. The sidewall 108 has an outer surface 116 that orients outwardly, and an inner surface 118 that forms the cavity that contains the fluid 200 and ice 202. The housing 102 is also defined by a base end 110 disposed at the lower region 106. The base end 110 serves to cap one end of the sidewall 108, and also serves as the foundation for resting the housing 102.

The housing 102 is also defined by a rim end 112 disposed opposite the base end 110. The rim end 112 may be disposed at the terminus of the upper region 104 of the housing 102. In some embodiments, the rim end 112 includes a rim 114 that forms the periphery for the housing 102. Also, the rim end 112 forms an opening 120 through which fluid 200 and/or ice 202 can be deposited into the housing 102; and through which the fluid 200 flows when drinking from the housing 102. An ice trap 122, discussed below, restricts the ice 202 from egress past the rim 114 and opening 120.

Figure 2:
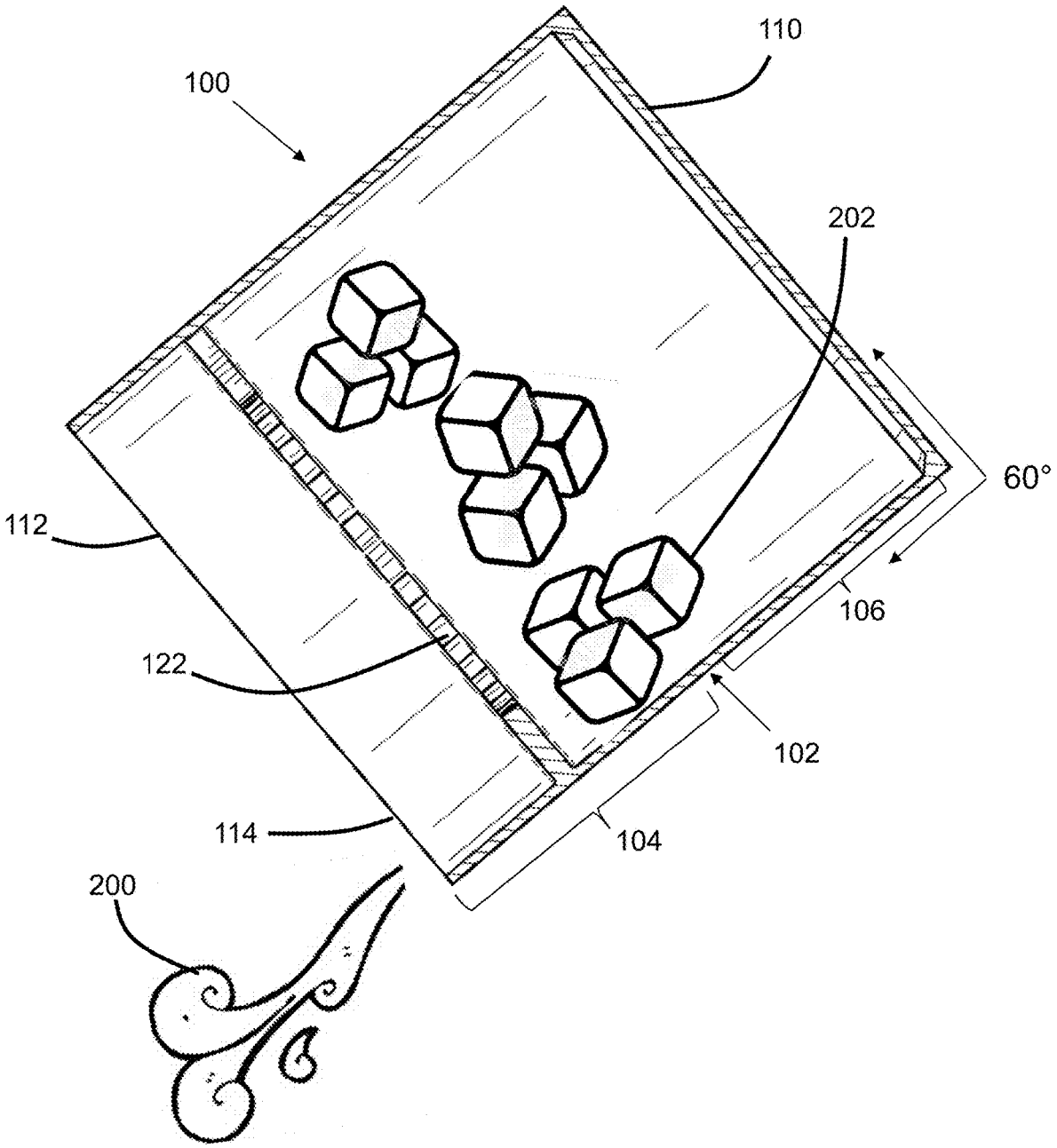
FIG. 2 is a perspective view of the ice restraining drinking receptacle shown in FIG. 1 being tipped over 60° to enable fluid to flow through the ice trap while also trapping ice, according to one embodiment.

As illustrated back in FIGS. 1 and 2, in one non-limiting embodiment, the user may grasp the housing 102 and tilt to a desired angle for drinking; whereby the ice contained inside the housing 102 is restrained from pouring out with the fluid 200, or engaging the teeth in the mouth.

As discussed above, the receptacle 100 is unique in that an ice trap 122 restricts any ice 202 contained in the housing 102 to be trapped, or physically restrained, from falling out through the opening 120 when tipped over for drinking. This tipping range of the housing 102 may include a 45°-90° tilt towards the mouth. For example, FIG. 2 shows the housing 102 being tipped over 60° to enable fluid 202 to flow through the ice trap 122 while ice trapped and restricted from following the fluid 200. Thus, the ice trap 122 is configured to form a uniform barrier across the circumferential range of the upper region 104 for the housing 102.

Figure 3:
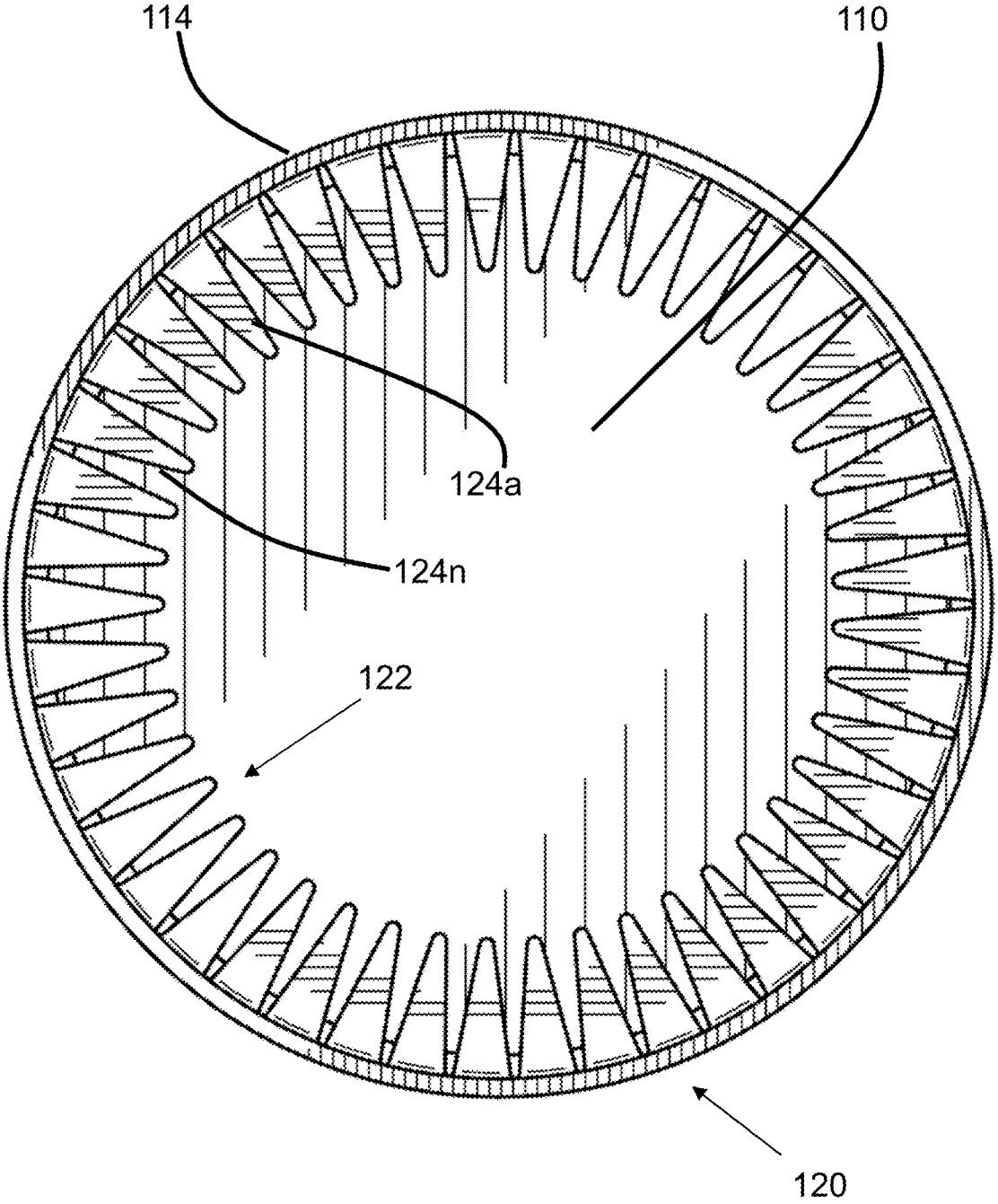
FIG. 3 is a top view of the ice restraining drinking receptacle shown in FIG. 1, according to one embodiment.

In one possible embodiment shown in FIG. 3, the ice trap 122 includes a plurality of protrusions 124*a-n* that are disposed in a spaced-apart relationship. The protrusions 124*a-n* form a circumferential relationship on the inner surface 118 of the housing 102. In one embodiment, a small uniform gap, i.e., 0.25-2 mm, forms between individual protrusions 124*a*, 124*n*. This circumferential arrangement of protrusions 124*a-n* ensures that a linear barrier forms across the upper region 104 to restrict movement of ice 202 towards the rim 114 and opening 120.

As discussed above, the protrusions 124*a-n* are disposed anywhere along the upper region 104 of the housing 102. The ice 202 moves freely through the lower region 106 of the housing 102, and slides easily to the ice trap 122 along with the fluid, before being restricted from further advancement through the upper region 104. This containment of ice 202 creates optimal cooling for the fluid. Nonetheless, since there exists a space between each individual protrusion, the fluid 200 alone is allowed to flow freely from the lower region 106 to the upper region 104, and finally through the opening in the housing 102.

Figure 4:
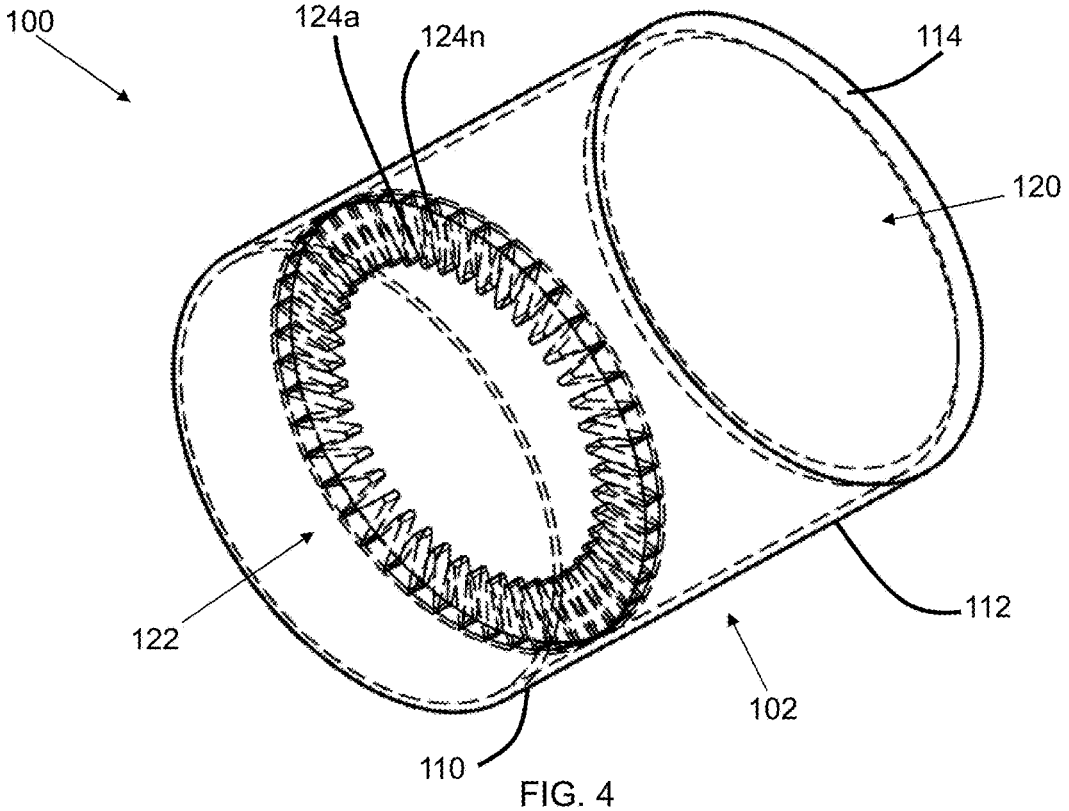
FIG. 4 is a perspective view of another possible embodiment of the ice restraining drinking receptacle, according to one embodiment.

As illustrated in FIG. 4, the protrusions 124*a-n* are defined by a mount end 126 and an apex end 128. The mount end 126 may fixedly or detachably join the inner surface 118 of the housing 102 in an orthogonal relationship. This 90° interface creates optimal orientation for catching the ice 202. However, in other embodiments, any angle greater or lesser than 90° could be possible.

In one possible embodiment, the mount end 126 of the protrusions 124*a-n* is a rectangular solid or hollow rectangular box. Such a rectangular box can be exploited to detachably mate the protrusion to the inner surface of the housing. This attachability means may include a screwing motion, a snap-fit mechanism, a weld, a bolt, a screw, a nail, and an adhesive. Further, the apex end 128 of the protrusions 124*a-n* is a solid or hollow pyramid. FIG. 1 illustrates the unique shapes and dimensions of the mount end and apex end of protrusions 124*a-n*.

Figure 5:
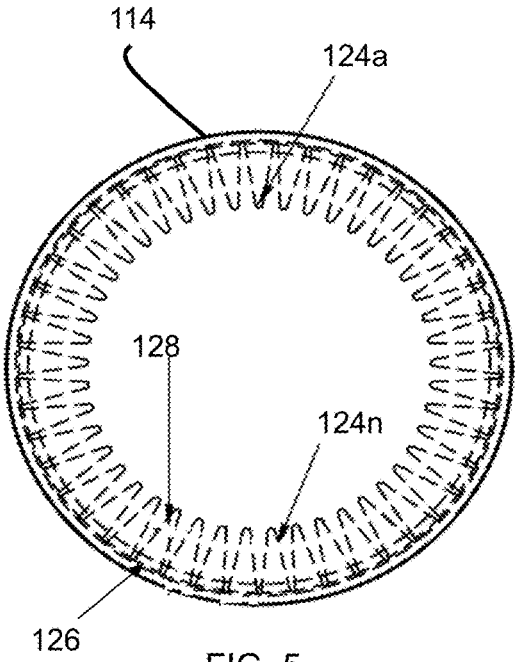
FIG. 5 is a top view of the ice restraining drinking receptacle shown in FIG. 4, according to one embodiment.

As illustrated back in FIG. 5, the protrusions 124*a-n* are formed all the way from the mount end 126 to the apex end 128 forming a generally pyramid shape, wherein the apex end 128 is pointed. The pointed apex end 128 is sufficiently sharp, so as to catch the ice. In alternative embodiments, ridges and flanges may form along the length of the protrusions 124*a-n* to create additional grip for catching the ice. This creates a configuration in which the mount end 126 is wider, and thereby more restrictive of larger ice cubes, ice shards, and the like.

It is significant to note that the pyramid shape of the protrusions 124*a-n* also provides an ornamental effect at the upper region 104 of the housing 102. However, in other embodiments, the protrusions 124*a-n* may include a triangular shape, an oval shape, a semi-circular shape, a hammer shape, and a rectangular shape.

As referenced in FIG. 5, the protrusions 124*a-n* are connected in an annular arrangement to the inner surface of the housing 102. Thus, a brace, wire, or their connectivity member may pass through each protrusion to create the annular, square, or triangular shape thereof. It is significant to note that for a cube-shaped or rectangular-shaped housing, the protrusions 124*a-n* are connected in a square shape, for example.

Figure 6:
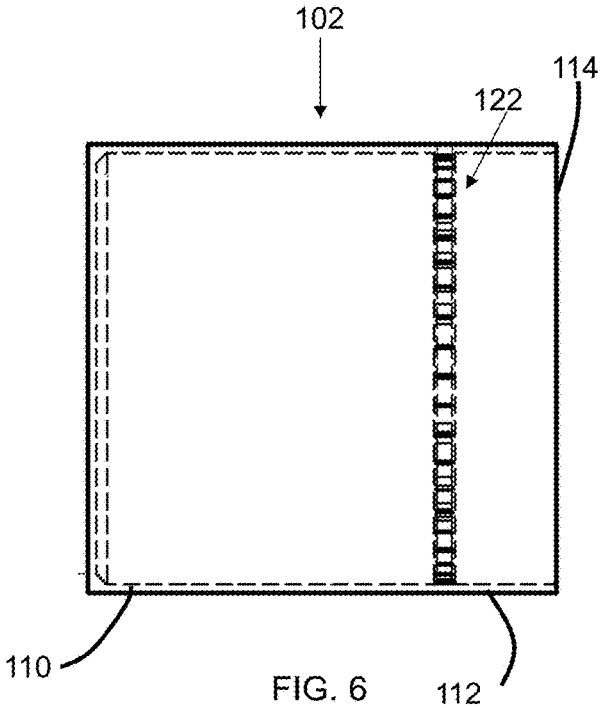
FIG. 6 is an elevated side view of the ice restraining drinking receptacle shown in FIG. 4, according to one embodiment.

In another possible embodiment shown in FIG. 6, the protrusions 124*a-n* are individually joined in an annular arrangement to the inner surface 118 of the housing 102. The protrusions 124*a-n* may be welded to the inner surface 118 of the housing 102, or may detachably attach to the inner surface 118 through a snap-fit mechanism, a screw, a magnet, or other food and beverage container fastening mechanism known in the art.

In operation, the user can fill a fluid, such as a beverage, and ice, including ice cubes, into the housing 102 through the opening. The ice trap 122 does not inhibit either from ingression freely into the housing 102. The user may then grasp the housing and tip the rim to the mouth to drink. The fluid 200 flows through the space between the protrusions 124*a-n*, while the ice 202 is restricted from passing as the protrusions 124*a-n* serve as a physical barrier (See FIG. 2).

Figure 7:
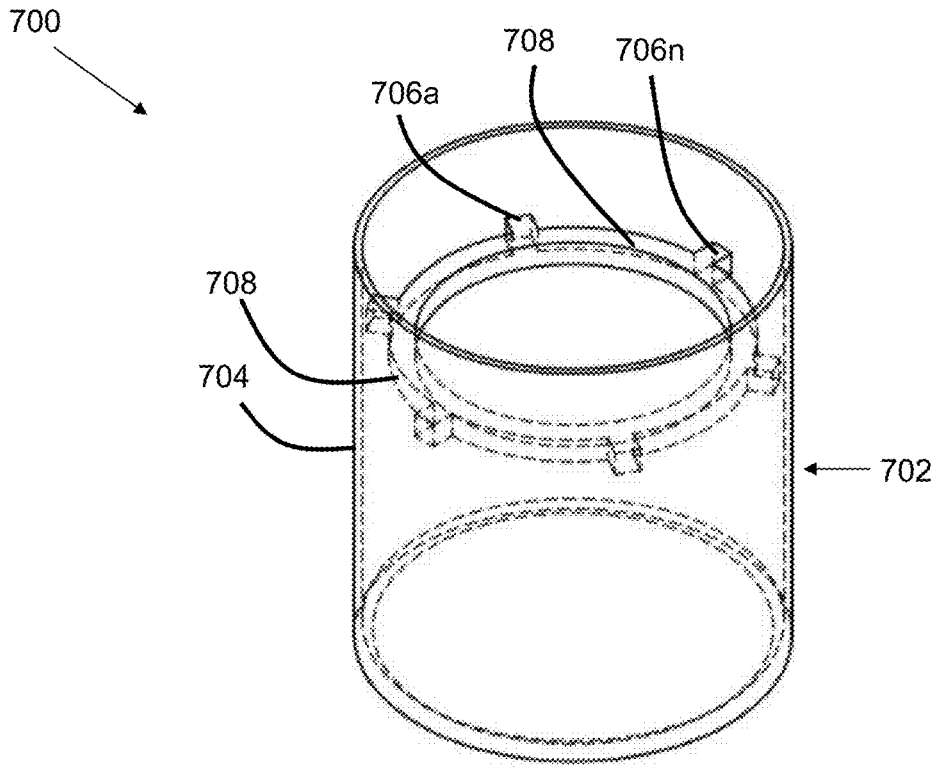
FIG. 7 is a perspective view of an alternative embodiment of the ice restraining drinking receptacle, according to one embodiment.
Figure 8:
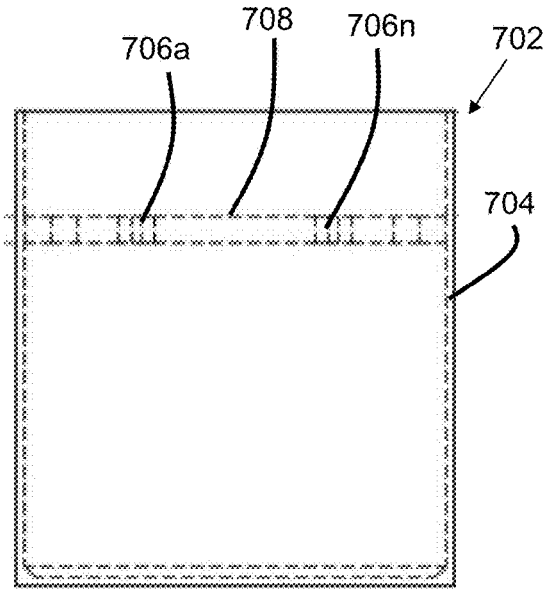
FIG. 8 is a side view of an alternative embodiment of the ice restraining drinking receptacle, according to one embodiment.

FIG. 7 references an alternative embodiment of the ice restraining drinking receptacle 700. In this alternative embodiment, a drinking receptacle housing 702 is defined by an outer sidewall 704 and an inner barrier rim 708. Multiple protrusions or attachments 706*a-n* (which optionally may be spaced apart equidistant and could be screws) work to hold the inner barrier rim 708 inside the outer housing 702 (See FIG. 8). The protrusions or attachments 706*a-n* may be welded or adhered with an adhesive to the inner barrier rim 708 and outer sidewall 704.

Figure 9:
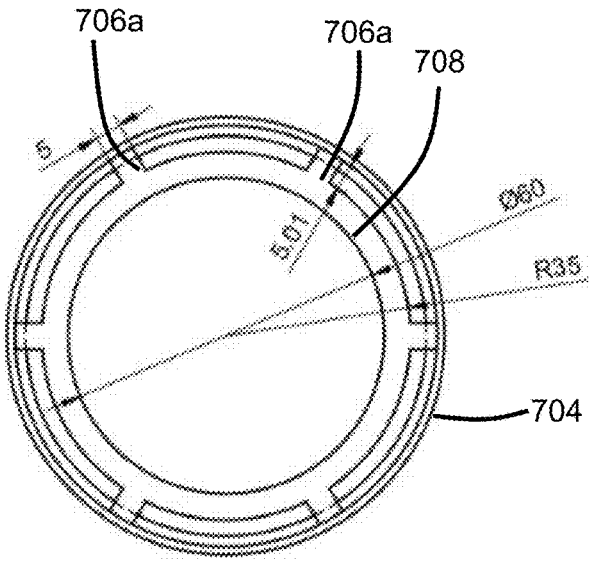
FIG. 9 is a top view of an alternative embodiment of the ice restraining drinking receptacle, according to one embodiment.
Figure 10:
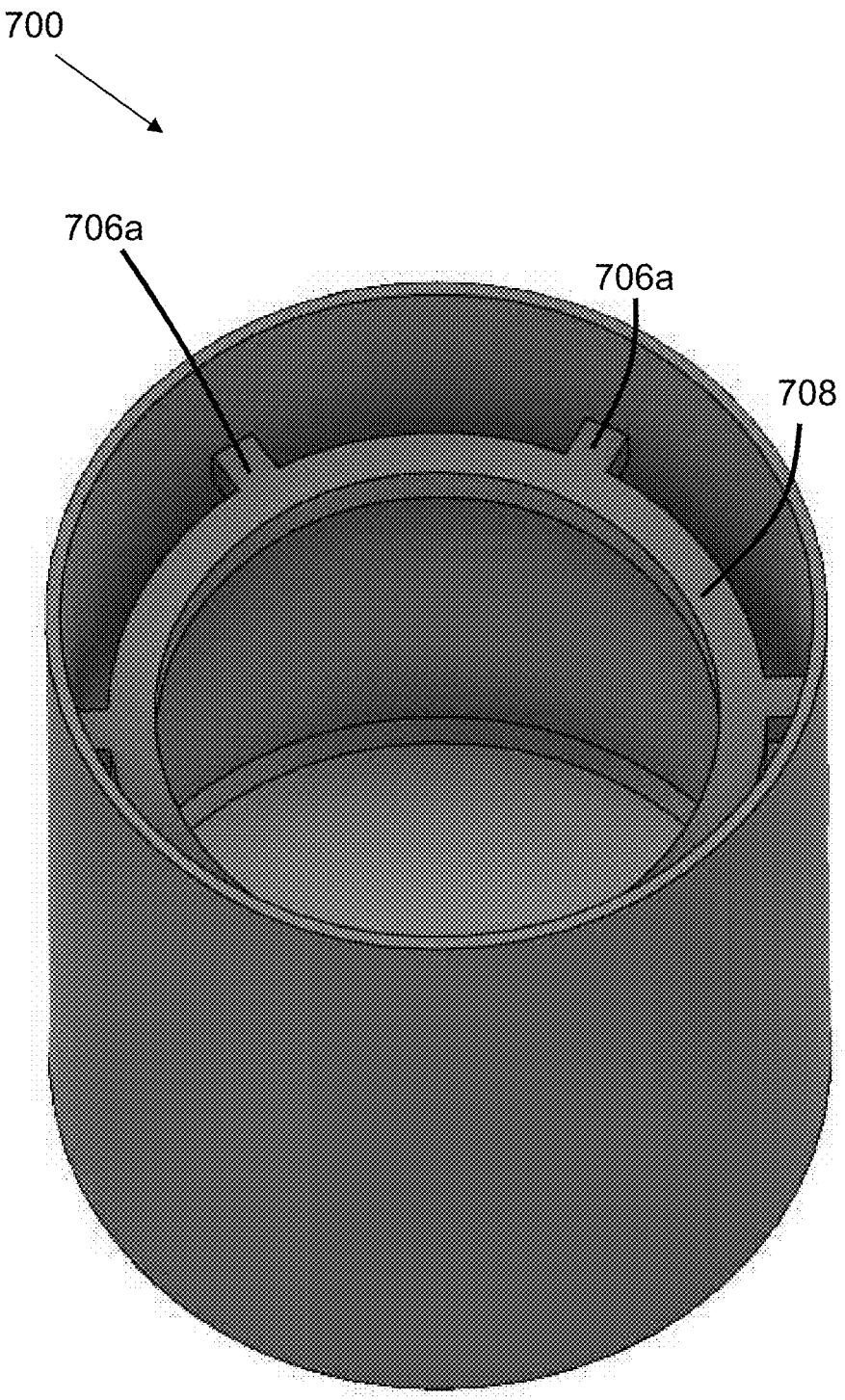
FIG. 10 is a perspective view of an alternative embodiment of the ice restraining drinking receptacle, according to one embodiment.

Continuing with the alternative embodiment 700, the inner barrier rim 708 restrains the ice and the liquid can pass in the small passage between the inner barrier rim 708 and sidewall 704. The inner barrier rim 708 and the protrusions 706*a-n* restrict movement of ice between the housing 702 and the inner barrier ring 708. The ring 708 has an inside diameter and an outside diameter. The outside diameter is less than the inside diameter of the drinking receptacle, vessel or cup. Optionally, the protrusions have surfaces that are level with the surface of the ring. Optionally, both surfaces of the protrusions are level and flush with the top and bottom surfaces of the ring. The ice trap is also effective in this embodiment, because as the drinking receptacle gets tilted to allow the liquid to flow into the mouth, the inner rim 708 acts like a barrier to restrain the ice and the liquid can pass through a small space between the inner rim 708 and sidewall 704. One non-limiting dimension is illustrated in FIG. 9, showing the space between the outer dimension of inner rim 708 and sidewall 704 is 5 mm as well as the distance between outer dimension and inner dimension of the inner rim is also 5 mm. In this variant, the space between upper surface and lower surface of the inner rim which makes the thickness of the inner rim 708 is also 5 mm, however, in other embodiments, the dimensions may be greater or less, as the present invention is scalable.

In FIGS. 7-10, the number of protrusions holding the inner rim is 6 protrusions in total. However, in other embodiments, the numbers may be greater or less, as the present invention is scalable.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence The present invention contemplates that many changes and modifications may be made. Therefore, while the presently-preferred form of the system has been shown and described, and several modifications and alternatives discussed, persons skilled in this art will readily appreciate that various additional changes and modifications may be made without departing from the spirit of the invention, as defined and differentiated by the following claims.

What is claimed is:

1. An ice restraining drinking receptacle, comprising:

a housing defined by an upper region and a lower region, the housing further being defined by a sidewall, a base end disposed within the lower region, and a rim end disposed within the upper region and having a rim, the rim end forming an opening; and an ice trap having:

a plurality of protrusions individually joined to an inner surface of the housing and disposed in a spaced-apart relationship, the protrusions further being disposed in a circumferential relationship on the inner surface and the upper region of the housing.

2. The receptacle of claim 1, wherein the housing comprises a mug.

3. The receptacle of claim 1, wherein the housing has a cylindrical shape.

4. The receptacle of claim 1, further comprising a handle disposed on the outer surface of the housing.

5. The receptacle of claim 1, wherein the protrusions are defined by a mount end joined to the inner surface and an apex end.

6. The receptacle of claim 5, wherein the protrusions are formed from the mount end to the apex end.

7. The receptacle of claim 6, wherein the apex end is pointed.

8. The receptacle of claim 1, the protrusions are connected to the inner surface in an annular arrangement.

9. The receptacle of claim 1, wherein the protrusions are individually joined in an annular arrangement to the inner surface of the housing.

10. The receptacle of claim 1, wherein the base end of the protrusions is welded to the inner surface of the housing in an orthogonal relationship.

11. The receptacle of claim 1, wherein the mount end of the protrusions is a rectangular solid or hollow rectangular box, and further, the apex end is a solid or hollow pyramid.

12. The receptacle of claim 1, the protrusions include at least one of the following shapes: a triangular shape, an oval shape, a semi-circular shape, a hammer shape, and a rectangular shape.

13. An ice restraining drinking receptacle, comprising:

a housing defined by an upper region and a lower region, the housing further being defined by a sidewall, a base end disposed within the lower region, and a rim end disposed within the upper region and having a rim, the rim end forming an opening;

and an ice trap having:

a plurality of protrusions individually joined to an inner surface of the housing and disposed in a spaced-apart relationship, the protrusions further being disposed in a circumferential relationship on the inner surface of the housing and the upper region of the housing, the protrusions being defined by a mount end joined to the inner surface and an apex end, the protrusions are formed from the mount end to the apex end.

14. The receptacle of claim 13, wherein the apex end is pointed and the protrusions are connected in an annular arrangement.

15. The receptacle of claim 13, wherein the protrusions are individually joined in an annular arrangement to the inner surface of the housing.

16. The receptacle of claim 13, wherein the base end of the protrusions is welded to the inner surface of the housing in an orthogonal relationship.

17. The receptacle of claim 13, wherein the mount end of the protrusions is a rectangular solid or hollow rectangular box, and further, the apex end is a solid or hollow pyramid.

18. An ice restraining drinking receptacle, comprising:

a mug defined by an upper region and a lower region, the mug further being defined by a sidewall, a base end disposed within the lower region, and a rim end disposed within the upper region and having a rim, the rim end forming an opening;

and an ice trap having:

a plurality of protrusions disposed in a spaced-apart relationship, the protrusions further being disposed in a circumferential relationship on an inner surface of the mug and the upper region of the mug, the protrusions being defined by a mount end and an apex end, the mount end joined to the inner surface in an orthogonal relationship, the protrusions formed from the mount end to the apex end, the apex being pointed, the protrusions including at least one of the following shapes: a triangular shape, an oval shape, a semi-circular shape, a hammer shape, and a rectangular shape.

19. An ice restraining drinking receptacle, comprising:

a vessel defined by an upper region and a lower region, the vessel further being defined by a sidewall, a base end disposed within the lower region, and a rim end disposed within the upper region and having a rim, the rim end forming an opening;

and an ice trap formed by a ring having an outside circumference and an inside circumference, the ring being hollow inside the inside circumference and the outside diameter being less than an inside diameter of the sidewall of the vessel;

a plurality of protrusions individually joined to an inner surface of the vessel and disposed in a spaced-apart relationship, the protrusions further being disposed in a circumferential relationship on the inner surface of the vessel and the upper region of the vessel, the protrusions being attached to the outer circumference of the ring and the sidewall of the vessel.

20. The ice restraining drinking receptacle of claim 19, wherein the protrusions have surfaces that are level and continuous with a surface of the ring.

* * * * *